United States Patent [19]

DeBolt

[11] Patent Number: 4,819,348

[45] Date of Patent: Apr. 11, 1989

[54] DITCH FORMING MACHINE

[76] Inventor: Charles H. DeBolt, R.R. #1, Box 95, Washburn, Ill. 61570

[21] Appl. No.: 85,949

[22] Filed: Aug. 17, 1987

[51] Int. Cl.[4] ..... E02F 5/04

[52] U.S. Cl. ..... 37/81; 37/255; 198/657

[58] Field of Search ..... 37/81, 82; 198/657, 198/674, 802, 854; 414/526

[56] References Cited

U.S. PATENT DOCUMENTS

| | | | |
|---|---|---|---|
| 1,301,833 | 4/1919 | Geveke | 37/81 |
| 3,098,208 | 6/1962 | Oglesby et al. | 37/81 |
| 3,328,902 | 7/1967 | Hanson | 37/81 |
| 4,117,689 | 10/1978 | Martin | 37/81 |
| 4,459,767 | 7/1984 | Lartner | 37/81 |

FOREIGN PATENT DOCUMENTS

| | | | |
|---|---|---|---|
| 149318 | 3/1952 | Australia | 37/81 |
| 520959 | 1/1956 | Canada | 37/81 |

*Primary Examiner*—Eugene H. Eickholt

*Attorney, Agent, or Firm*—Walters R. E.

[57] ABSTRACT

The present invention relates to a ditch forming machine and is specifically concerned with providing such a machine for forming the oppositely sloping sides of a ditch in a single pass. Prior art machines could only form one side of the ditch at a time with the machine then having to be turned 180 degrees to form the opposite side thereof. The present invention overcomes these deficiency by providing a ditch forming machine which provides a pair of offset screw-auger assemblies with earth severed by the leading auger assembly being directed to the trailing auger for discharge of all severed material from the ditch during a single pass. The auger assemblies are conveniently angularly adjustable relative to each other for forming any desired angularity of the opposite sides of the ditch while conveying material discharged from the ditch a substantial distance laterally outwardly from the prime mover vehicle which is adapted to always be position on the flat ground along side the ditch being formed.

17 Claims, 4 Drawing Sheets

DITCH FORMING MACHINE

DESCRIPTION

1. Technical Field

The present invention relates to a ditch forming machine for initially digging or cleaning out established irrigation and drainage ditches, canals and the like and more particularly to such a machine having a pair of earth engaging screw augers which cooperate to both sever encountered earth as a digging and cutting tool and to simultaneously convey and discharge such severed earth outwardly from the ditch.

2. Background Art

Presently, conventional ditch forming machines provide separate earth digging or cutting tools along with some type of continuously running endless belt-type conveyor for transporting earth severed by the cutting tools upwardly outwardly from the ditch being formed. The digging or cutting tools usually consist of some form of bulldozer or scraper blade which are angled sufficiently that during forward earth traversing movement of the machine severed earth is rolled along the cutting edge for discharge at the trailing end of the blade. Although the blades are angled to discharge outwardly from the ditch a large amount of loose earth usually falls downwardly into the bottom portion of the ditch requiring additional passes by the machine in an effort to pick up and discharge any material previously missed. These prior art ditch forming machines also have a continuously running endless belt-type conveyor mounted in association with the blade which include a lower scoop-type receiving end to pick up any loose earth in the bottom of the ditch. These, however, by virtue of their position within the bottom of the ditch are highly vulnerable to damage by large clods of dirt or heavy rocks falling into the ditch and onto such scoop portion of the conveyor. The scoop is also subject to possible damage by running into such large clods or rocks during normal forward earth traversing movement of the machine in the ditch which are not constructed to easily handle or accommodate such oversized objects.

At best, the above described prior art machines are only intended to form one side of the ditch during any one pass. With blade-type cutting tools, multiple passes along the ditch is usually necessary if the ditch is intended to have any appreciable depth. Even more passes are then necessary to form the opposite sides of the ditch which requires turning the machine 180 degrees undesirably resulting in dual windrows of discharged material on each side of the ditch. Such procedure further requires many blade adjustments as the ditch becomes deeper and is difficult to control with any accuracy since the wheels of the support vehicle on which the digging machine is mounted is continually encountering a different rolling surface particularly if the wheels on one side of the machine are positioned out of the ditch and the opposite wheels are running within the ditch. Ditch forming machines that run with all four wheels within the ditch ultimately have a difficult time extracting themselves from the finished ditch of any depth and usually require towing by another vehicle. It is therefore recognized that an improved ditch forming machine for forming ditches having oppositely sloping sides is desirable which is adapted to form both sides of the ditch simultaneously in a single pass and which permits the vehicle to travel on the substantially flat ground along side the ditch as it is being formed. Accordingly, the present invention is directed to overcoming the problems as set forth above.

DISCLOSURE OF THE INVENTION

In accordance with one aspect of the present invention, there is provided a ditch forming machine which has a mobile frame adapted for earth traversing movement in a predetermined forward generally longitudinal direction of travel along a ditch being formed by a pair of elongated powered earth engaging screw auger assemblies mounted on the frame in offset oppositely extended relation from each other substantially transversely of said longitudinal direction of travel so that the outermost auger assembly is effective to sever encountered earth and to direct it to the other auger assembly for discharge from the ditch.

BEST MODE FOR CARRYING OUT THE INVENTION

Figure 1:
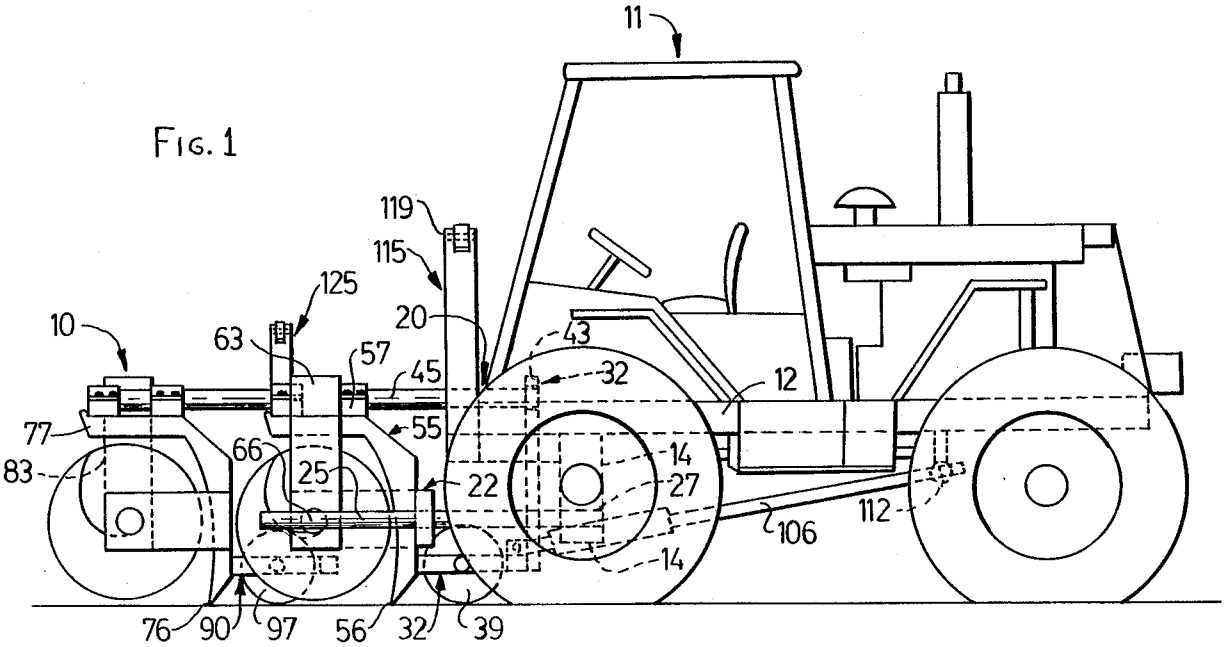
FIG. 1 is a side elevational view of the ditch forming machine of the present invention shown mounted on a wheel vehicle for earth traversing movement in a predetermined forward direction of travel.
Figure 2:
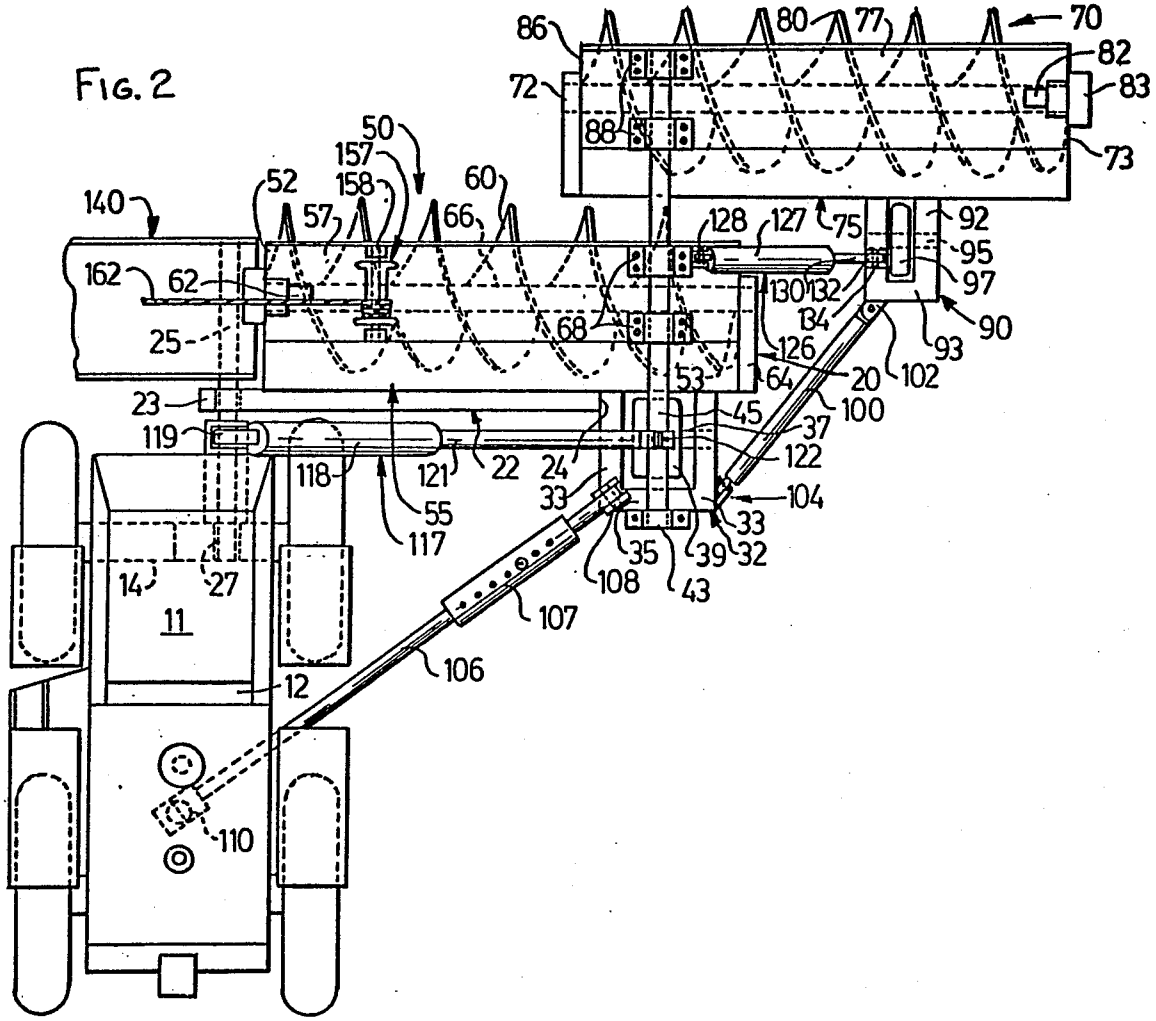
FIG. 2 is a top plan view of the ditch forming machine and wheel vehicle of claim 1.

Referring more particularly to FIGS. 1 and 2 of the drawings, a ditch forming machine embodying the principles of the present invention is generally designated by the reference numeral 10 which is mounted in laterally offset relation to a prime mover or wheel vehicle 11. The wheel vehicle includes an elongated frame 12 which is adapted for earth traversing movement in a generally longitudinal direction of travel and has a front axle housing 14 off of which the ditch forming machine 10 is primarily supported.

The ditch forming machine 10 includes a fabricated frame 20 which has an elongated main mounting beam 22 providing an inner mounting end 23 and an opposite outer distal end 24. An elongated main push arm 25 has an inner mounting end 27 rigidly connected to the front axle 14 of the prime mover vehicle 11 as by a welding or the like. The inner mounting end 23 of the main mounting beam 22 is elevationally pivotally mounted on the push arm 25.

The auger frame 20 further includes a box frame generally indicated by the reference numeral 32 in outwardly extended rearwardly trailing relation to the distal end 24 of the main mounting beam 22 and provides a pair of opposite side rails 33 rigidly interconnected by a rear cross rail 35. An elongated axle 37 is secured in bridging relation between the opposite side rails and mounts thereon a ground engaging wheel 39. An upstanding rear support plate 41 is rigidly secured in substantially vertically upwardly extended relation from the rear rail 35 and has mounted on its uppermost end a bolt-on shaft mounting block 43. An elongated rocker shaft 45 is mounted in cantilevered relation from the mounting block 43 in forwardly extended relation therefrom substantially aligned with the longitudinal direction of travel of the auger frame 20.

The auger frame 20 provides mobile support for an inner auger assembly generally indicated by the reference numeral 50 which has predetermined inner and outer ends 52 and 53, respectively. An elongated forwardly upwardly curving earth scraping blade 55 is secured to the forward side of the main mounting beam 22, as by welding or the like, and includes a lower cutting edge 56 adapted to be disposed in lightly engaging scraping relation with the surface of the ditch being cut. The blade has an upper canopy portion 57 disposed in substantially horizontal position forwardly extended from the blade in space substantially parallel relation to the ground. An elongated spiral screw auger blade 60 is disposed in nested relation forwardly of the blade 55 and beneath the upper canopy 57 thereof. The auger blade 60 is driven by a hydraulic motor 62 through a chain drive mechanism 63 connected to an elongated drive shaft 64 rotatably mounted in opposite end mounting arms 66 forwardly endwardly extended from the ends of the blade 55. A pair of bolt-on bearing blocks 68 are mounted on the canopy portion 57 of the blade adjacent to the outer end 53 of the blade which are journaled on the rocker shaft 45 in forwardly spaced relation from the main mounting beam 22.

An outer auger assembly is generally indicated by the references numeral 70 and is mounted on the rocker shaft 45 forwardly adjacent to the inner auger assembly 50 and has opposite inner and outer ends 72 and 73, respectively. A scraper blade 75 having a cutting edge 76 and an upper canopy 77 is provided to mount a screw auger blade 80 laterally outwardly and ahead of the outer end 53 of the inner auger assembly 50. The screw auger blade is driven by a hydraulic motor 82 through a chain drive assembly 83 and an elongated drive shaft 84 journaled in opposite outer end mounting arms 86. The outer auger assembly has a pair of bearing blocks 88 bolted to the top of the canopy 77 adjacent to the inner end 72 of the auger assembly which are journaled on the outer end of the rocker shaft 45. A pair of support wheel assemblies 90 are mounted adjacent to the opposite ends 72 and 73 of the outer auger assembly 70 by a pair of opposite side rails 92 interconnected by a rear rail 93. Each of the supports include an elongated axle 95 which mounts a ground engaging wheel 97 in trailing relation to the outer auger assembly 70. An elongated diagonal brace 100 provides a clevis and pin mounting 102 on the outermost wheel support assembly 93 and a clevis and pin mounting assembly 104 disposed upon the rear rail 35 of the support frame 32. An extendably retractable diagonal brace 106 is extended between the main support frame 32 and the vehicle and includes an elongated gas cylinder 107 secured by a clevis and pin assembly mounting 108 to the rear of the main support frame 32 and has an opposite ball joint mounting 110 connected to the frame 12 of the vehicle by a universal joint mounting 112.

An upwardly extended support tower 115 is secured in upstanding relation from the mounting block 29 of the main push arm 25 and is adapted to support a hydraulic jack 117. The jack has a cylinder end 118 which is connected to the tower by a clevis and pin assembly 119. The jack also includes an opposite rod end 121 which has an enlarged bearing end 122 journaled on the rocker shaft 45 rearwardly adjacent to the shaft mounting block 43 on the main support frame 32. A jack mounting tower 125 is disposed in upwardly extended relation from the outer end 53 of the inner auger assembly 50 and mounts a hydraulic jack 126. The jack has a cylinder end 127 connected to the tower by way of a clevis and pin assembly 128 and an opposite rod end 130 having an enlarged sleeve portion 132 connected by way of a clevis and pin assembly 134 on the outermost wheel support frame 90 of the outer auger assembly 70.

Figure 3:
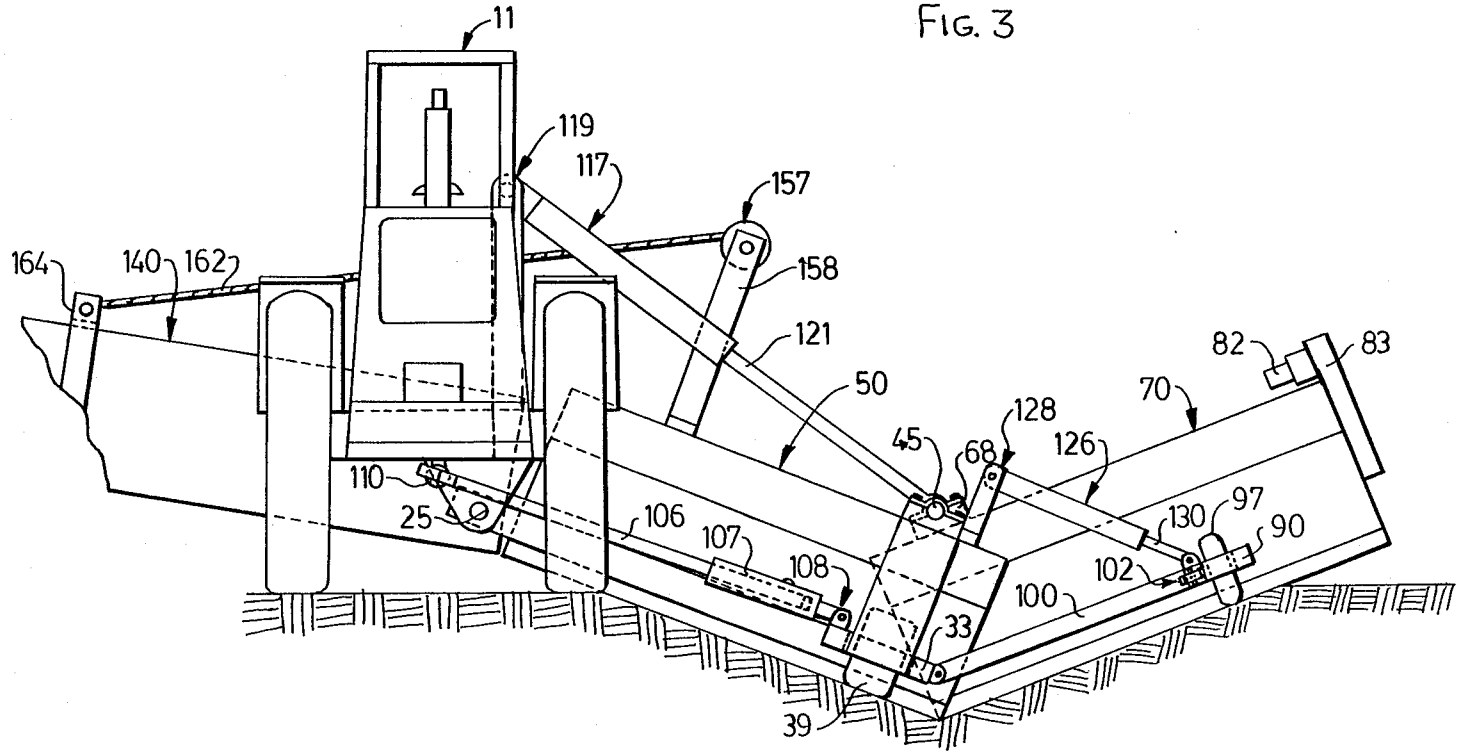
FIG. 3 is a rear elevational view showing the screw auger assemblies disposed in an operating ditch cutting position laterally offset from the vehicle.
Figure 4:
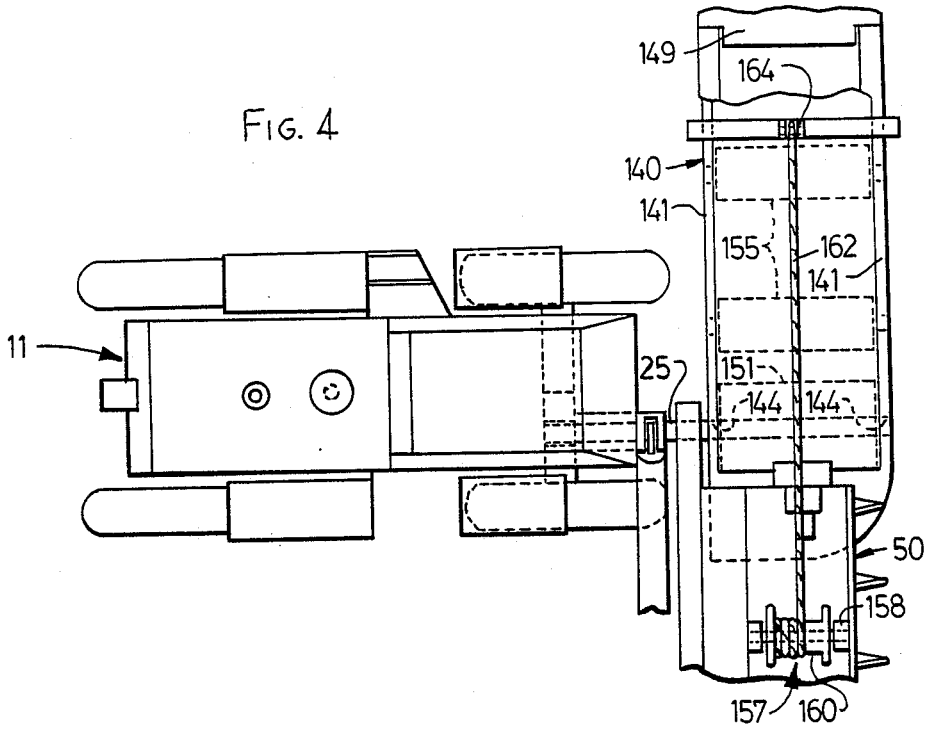
FIG. 4 is a top plan view of a belt-type earth discharging conveyor for receiving severed earth from the auger assemblies for discharge of such material laterally outwardly from the vehicle.
Figure 5:
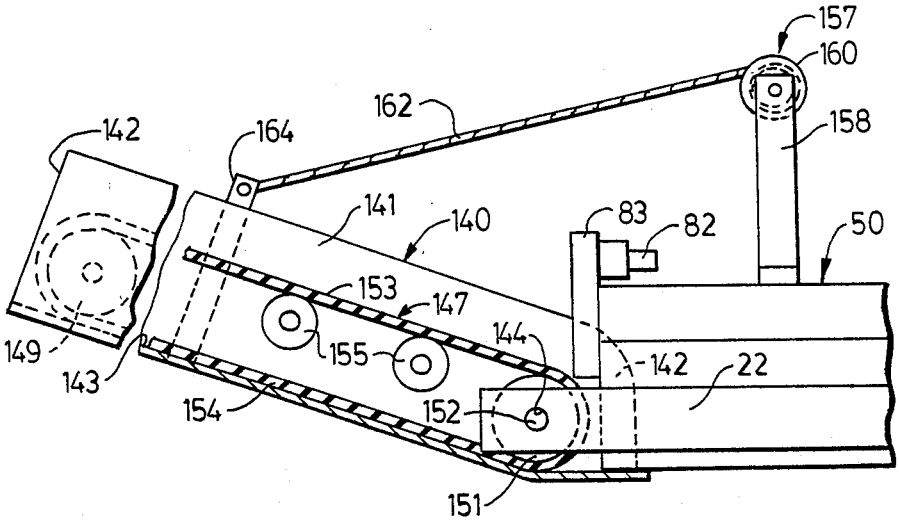
FIG. 5 is a somewhat enlarged partial sectional view of the conveyor and adjusting mechanism of FIG. 4.

As best shown in FIGS. 3, 4 and 5 an elongated earth discharged conveyor 140 is forwardly mounted on the vehicle 11 and has an elongated trough-like frame 141 having opposite sidewalls 142 and a bottom floor plate 143. A pair of conveyor mounting apertures 144 are formed in the sidewalls of the conveyor trough for pivotal mounting on the main push arm 25. The conveyor includes an angled pan portion 145 which is adapted to underlie the innermost end of the auger blade 60 for receiving material being severed and conveyed along the blade toward its inner end 52. The conveyor includes an elongated endless belt 147 which is trained in circuitous relation about an outer drive roller 149 and an inner idler roller 151. The belt provides an upper run 153 and an opposite lower run 154 with the former being supported on a plurality of spaced support rollers 155.

A powered conveyor adjusting mechanism generally indicated by the reference numeral 157 is provided for angularly adjusting the attitude of the conveyor relative to the ground. The adjusting mechanism includes a tower 158 mounted on the upper canopy 57 of the blade 55 of the inner auger assembly 50 which mounts a powered roller 160. A cable 162 is trained about the roller and has an opposite end connected to a bail-type bracket 164 upwardly extended from the opposite sides 142 of the conveyor.

INDUSTRIAL APPLICABILITY

As best shown in FIG. 3 prior to operation the hydraulic jack 117 is extended to lower the outer end 53 of the inner auger assembly 50 so as to form the downwardly sloping adjacent wall of a ditch laterally outwardly from one side of the prime mover vehicle 11. At the same time the hydraulic jack 126 is retracted to angularly position the outer auger assembly 70 with respect to the inner auger assembly causing the outer end of the outer auger assembly to be elevated for forming the outer side of the ditch in downwardly sloping relation corresponding to the opposite slope of the inner side of the ditch. The auger blades 60 and 80 are then rotated by their independent hydraulic motors 62 and 82, respectively in the same direction of rotation. Accordingly, during earth traversing movement of the prime mover 11 in a forward direction of travel the augers will cut into the encountered earth to form the angular sloping sides of the ditch depending upon the angle formed by the settings of the hydraulic jacks 117 and 126. Earth severed by the auger blade 80 will be discharged laterally inwardly of its inner end 86 directly into the path of the inner auger blade 60. The hydraulic motor 62 is set to drive the auger blade 60 at a substantially greater speed of rotation than the auger blade 80 in order to accommodate the increased flow of earth discharged from the outermost auger assembly 70 and also to convey any earth severed by the auger blade 60 laterally outwardly onto the receiving end of the conveyor 140. Such earth is dumped upon the upper run 153 of the conveyor belt 147 which is effective to transport such severed earth laterally outwardly from the opposite side of the vehicle 11 from the auger frame 20. The earth is then discharged from the outer end of the conveyor into a windrow along side the vehicle 11 in a position to guarantee that no loose earth material will fall back into the ditch being formed. It is readily apparent that the hydraulic jacks 117 and 126 can be actuated to provide any angular position between the inner and outer auger assemblies 50 and 70 to provide any degree of angular side slope for the ditch as might be desired. The support wheels 39 and 97 rollable engage the relatively smooth surface of the sidewalls being cut by the auger assemblies which effectively maintain their respective auger assemblies in their desired angular position with respect to each other. The scraper blades 55 and 75 further insure that substantially no loose severed earth material remains within the ditch and is effectively fed into the rotating auger blades for complete removal from the ditch onto the discharge conveyor 140.

In view of the foregoing it is readily apparent that the structure of the present invention provides an improved ditch forming machine which enables a ditch with oppositely sloping sides to be formed in a single pass. The longitudinal staggered relation between the inner and outer auger assemblies are effective to not only initially sever the earth material encountered during forward movement of the prime mover 11 but also conveys such severed material from one to the other and thence outwardly from the ditch for complete removal of such material and deposit in a windrow spaced a substantial distance from the ditch. With the auger frame being laterally offset from the prime mover vehicle the wheels thereof are always positioned on the relatively flat ground along side the ditch being formed in order to insure that the ditch will accurately and precisely follow any contours of the earth being traversed in line with the ditch route.

I claim:

1. A ditch forming machine comprising:
a mobile auger frame adapted for earth traversing movement in a predetermined forward generally longitudinal direction of travel along such a ditch;
a pair of elongated powered earth engaging screw-auger assemblies mounted on said auger frame in offset oppositely extended relation from each other substantially transversely of said longitudinal direction of travel;
said auger frame including an elongated rocker shaft disposed in elevated position thereon and having an axis substantially aligned with said longitudinal direction of travel;
and means individually mounting said screw-auger assemblies on said rocker shaft in fore and aft staggered relation.

2. The ditch forming machine of claim 1 wherein said screw-auger assemblies individually includes predetermined inner and outer ends with the outer end of one being mounted on said rocker shaft rearwardly adjacent to the inner end of the other relative to said direction of travel.

3. The ditch forming machine of claim 2 wherein each auger assembly has a spiral screw-auger blade rotatably mounted thereon;
and power means individually mounted on said auger assemblies for rotating said auger blades in the same direction of rotation.

4. The ditch forming machine of claim 3 in which said blade of said one of said auger assemblies is driven at a speed greater than the speed of the blade on said other of said auger assemblies.

5. A ditch forming machine for simultaneously cutting both sides of a ditch having oppositely sloping sides, comprising;
a prime mover having an elongated frame adapted for earth traversing movement in a forward generally longitudinal direction of travel;
a mobile auger frame pivotably mounted on said prime mover frame;
a pair of powered earth engaging screw-auger assemblies individually mounted on said auger frame in offset oppositely extended relation substantially transversely of said longitudinal direction of travel; and
means on said auger frame for angularly elevationally adjusting one auger relative to the other for varying the angle of slope of the sides of the ditch.

6. The ditch forming machine of claim 5 in which said auger frame includes an elongated rocker shaft disposed in elevated position thereon and having an axis substantially aligned with said longitudinal direction of travel;
and means individually mounting said screw-auger assemblies on said rocker shaft in fore and aft staggered relation.

7. The ditch forming machine of claim 6 wherein said screw-auger assemblies individually include predetermined inner and outer ends with the outer end of one being mounted on said rocker shaft rearwardly adjacent to the inner end of the other relative to said direction of travel.

8. The ditch forming machine of claim 7 wherein each auger assembly has a spiral screw-auger assembly blade rotatably mounted thereon;
and power means individually mounted on said auger assemblies for rotating said auger blades in the same direction of rotation.

9. The ditch forming machine of claim 8 in which said blade of said one of said auger assemblies is driven at a speed greater than the speed of the blade on said other of said auger assemblies.

10. The ditch forming machine of claim 9 in which said auger frame has a prime mover connector extended from the inner end of said one of said auger assemblies.

11. The ditch forming machine of claim 10 including a push arm forwardly extended from said prime mover frame pivotably mounting said inner end connector of said one of said auger assemblies;
a tower support member mounted in upstanding relation from said push arm;
and a hydraulic jack having an end mounted on said tower, and an opposite end connected to said rocker shaft.

12. The ditch forming machine of claim 11 including a jack support tower mounted in upstanding relation from said outer end of said one of said auger assemblies;
a hydraulic jack having an end mounted to said support tower, and an opposite end connected to the outer end of said other of said auger assemblies for angularly adjusting said one to the other.

13. The ditch forming machine of claim 12 in which each of said auger assemblies has an elongated earth engaging scraper blade mounted in accurately curving relation immediately behind their respectively associated screw-auger blades with an upper forwardly extended canopy portion thereabove.

14. The ditch forming machine of claim 13 including a plurality of ground engaging wheels individually mounted on said auger frames in trailing relation to said auger assemblies.

15. The ditch forming machine of claim 14 including a pair of spaced wheel mounting frames rigidly mounted in rearwardly extended relation from said scraper blade of said other of said auger assemblies individually adjacent to its opposite inner and outer ends;

and a wheel mounting frame rigidly mounted in rearwardly extended relation from said scraper blade of said one of said auger assemblies adjacent to its outer end.

16. The ditch forming machine of claim 15 including a diagonal brace having opposite ends mounted between said wheel mounting frame on said one of said auger assemblies and the wheel mounting frame of said outer end of said other of said auger assemblies;

and a gas cylinder having opposite ends mounted between said wheel mounting frame of said one of said auger assemblies and a point on said prime mover frame rearwardly spaced from said push arm.

17. The ditch forming machine of claim 16 including an elongated endless conveyor assembly mounted on said push arm and having a material receiving end adjacent to said inner end of said one of said auger assemblies, and an opposite discharge end laterally outwardly extended from said prime mover in an opposite direction from said auger frame;

and a roller tower mounted in upstanding relation from said one of said auger assemblies having an extendable-retractable cable mounted on the roller tower and an opposite end connected in angularly adjustable supporting relation to said conveyor assembly.

* * * * *